United States Patent [19]

Uchida

[11] 4,396,455

[45] Aug. 2, 1983

[54] DEVICE FOR AUTOMATICALLY TRANSFERRING AN ADHESIVE TAPE TO AN ARTICLE

[76] Inventor: Hiromichi Uchida, c/o Toyo Chemical Co., Ltd. Nikko Mita Bldg., 4-26, Takanawa 1-Chome, Minato-ku, Tokyo, Japan

[21] Appl. No.: 344,829

[22] Filed: Feb. 1, 1982

[51] Int. Cl.[3] ..... B32B 35/00

[52] U.S. Cl. ..... 156/577; 156/584

[58] Field of Search ..... 156/523, 527, 574, 577, 156/579, 584

[56] References Cited

U.S. PATENT DOCUMENTS

| | | | |
|---|---|---|---|
| 3,274,038 | 9/1966 | Karn | 156/577 |
| 3,969,181 | 7/1976 | Seabold | 156/577 |
| 4,220,495 | 9/1980 | Uchida | 156/577 |
| 4,336,097 | 6/1982 | Van Kampen et al. | 156/527 |

*Primary Examiner*—Michael G. Wityshyn

*Attorney, Agent, or Firm*—Wenderoth, Lind & Ponack

[57] ABSTRACT

This invention pertains to a device for automatically transferring an adhesive tape to an article. The device comprises a casing and a roll support shaft provided on the casing and on which a transferring adhesive tape roll is mounted, the tape roll including a rolled adhesive film having pressure sensitive adhesive substance on one face thereof and a rolled removable spacer tape disposed between the adjacent turns of the adhesive film. The lower adhesive face of the transferring adhesive tape roll is so arranged as to protrude out of a lower opening of the casing. An outlet for the spacer tape is provided in the casing at the top thereof. A resilient tape roll urging piece is supported on the casing to be urged against the transferring adhesive tape roll in the course of being fed toward the outlet. The transferring adhesive tape roll is rollingly forced against the article so that the adhesive film is transferred to the article while the removable spacer tape is separated from the adhesive film and fed through the outlet.

5 Claims, 8 Drawing Figures

DEVICE FOR AUTOMATICALLY TRANSFERRING AN ADHESIVE TAPE TO AN ARTICLE

BACKGROUND OF THE INVENTION

There have been proposed various devices for automatically transferring an adhesive film having an adhesive substance on one face thereof from a transferring adhesive tape roll to an article. In one of the prior devices, a removable spacer tape which is disposed between the adjacent turns of the adhesive film is separated from the adhesive film and then sequentially wound. Accordingly, there are means to unwind the transferring adhesive tape roll, means sensitive to pressure to transfer the adhesive film to the article and means to wind the removed spacer tape. Also, exquisite timing is required for keeping travel of the tape and its tension optimum and for smoothly feeding the spacer tape out of the device. A complicated gear arrangement is required to synchronize transferring the adhesive film with winding the removed spacer tape. Thus, the prior device disadvantageously has a large-scaled and complicated construction.

Another prior device has been provided in which a transferring adhesive tape roll serves as a pressure sensitive roller. However, this has many requirements, one of which is to make its construction simpler and another of which is to positively transfer the adhesive film to the article while it is kept at its required tension. Such a device is disclosed in U.S. Pat. No. 4,220,495, the invention of which was made by the same inventors as this invention. FIG. 1 shows the prior device. The device comprises a pair of support plates 1 and 2 of a frame (the support plate 1 is not shown in FIG. 1) and a roll support shaft 3 provided between the support plates 1 and 2. The support plates 1 and 2 and the roll support shaft 3 may be made of any suitable material such as pasteboard, plastic board or metal plate. A transferring adhesive tape roll 4 is mounted on an cylindrical bobbin annular 8 by winding on the bobbin a removable spacer tape 5 and a transferring adhesive film 7 having pressure sensitive adhesive substance 6 on one face thereof. The tape roll 4 is rotatably supported by mounting the bobbin 8 on the roll support shaft 3. The support plates 1 and 2 are cut off at their lower portion so that the adhesive transferring face of the tape roll 4 is caused to protrude out of the support plates 1 and 2 of the frame. After transferring the adhesive film 7 to the article, the spacer tape 5 is fed out of the frame through the space between edges 9*a* and 10*a* of a pair of pieces 9 and 10. The piece 9 is positioned at the angle tangent to the periphery of the tape roll 4 to force the spacer tape 5 so as to lead it out of the frame in a smooth manner. The piece 10 is so arranged that its edge 10*a* engages the back face of the spacer tape 5 and guides it out of the frame without following the periphery of the tape roll 4. The pieces 9 and 10 should be faced to each other at the space and the position of the pieces suitable for feeding the spacer tape 5 out of the frame so as to always urge the pieces against the tape roll 4. Thus, it is difficult to determine the position and the angle of the pieces 9 and 10. Since the urging force of the pieces against the tape roll 4 and the angle of the pieces vary as the tape roll 4 is consumed, it is difficult to maintain the space, the urging force and the angle of the pieces 9 and 10 suitable for feeding the spacer tape out of the device until the whole tape roll 4 is consumed. Thus, the device is manufactured with much difficulty.

SUMMARY OF THE INVENTION

Accordingly, it is a principal object of the invention to provide a device for automatically transferring an adhesive film having adhesive substance on one face thereof to an article in which its construction is simplified.

It is another object of the invention to provide a device for automatically transferring an adhesive film having an adhesive substance on one face thereof to an article, in which a removable spacer tape can be fed out although the diameter of the tape roll varies as it is consumed.

It is another object of the invention to provide a device for automatically transferring an adhesive film having an adhesive substance on one face thereof to an article which can be easily manufactured without any adjustment of the parts.

In accordance with the invention, there is provided a device for automatically transferring an adhesive tape to an article, comprising a casing having an opening provided at its lower edge, a roll support shaft mounted on said casing, and a transferring adhesive tape roll rotatably supported on said roll support shaft, said tape roll including a rolled adhesive film having a pressure sensitive adhesive substance on one face thereof and a rolled removable spacer tape disposed between the adjacent turns of said adhesive film and being so arranged that the lower adhesive face of said transferring adhesive tape roll protrudes out of said opening in said casing and said casing having an outlet provided to feed said spacer tape out of said casing therethrough, characterized by further comprising a resilient spacer tape urging piece mounted on said casing to urge the removed spacer tape against said transferring adhesive tape roll in the course of being fed toward said outlet.

BRIEF DESCRIPTION OF THE DRAWINGS

The above and other objects and features of the invention will be apparent from the description of the embodiments taken with reference to the accompanying drawings in which.

DETAILED DESCRIPTION OF THE EMBODIMENTS

Figure 2:
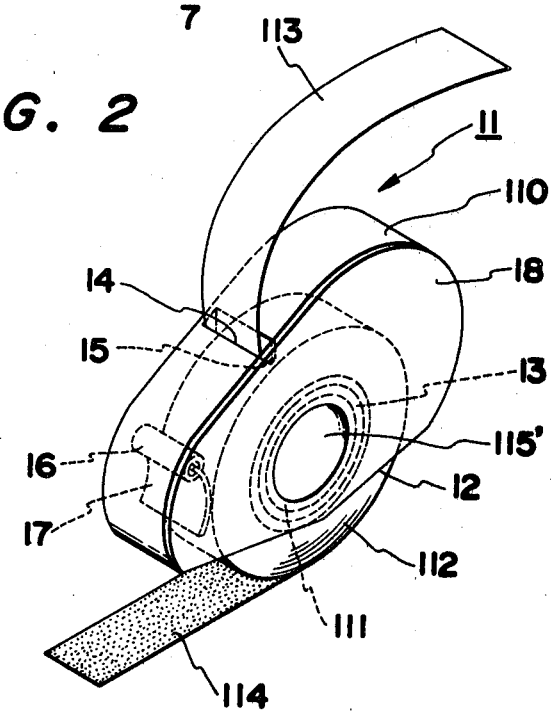
FIG. 2 is a perspective view of a device for automatically transferring to an article an adhesive film having an adhesive substance on one face thereof, constructed in accordance with the invention.
Figure 3:
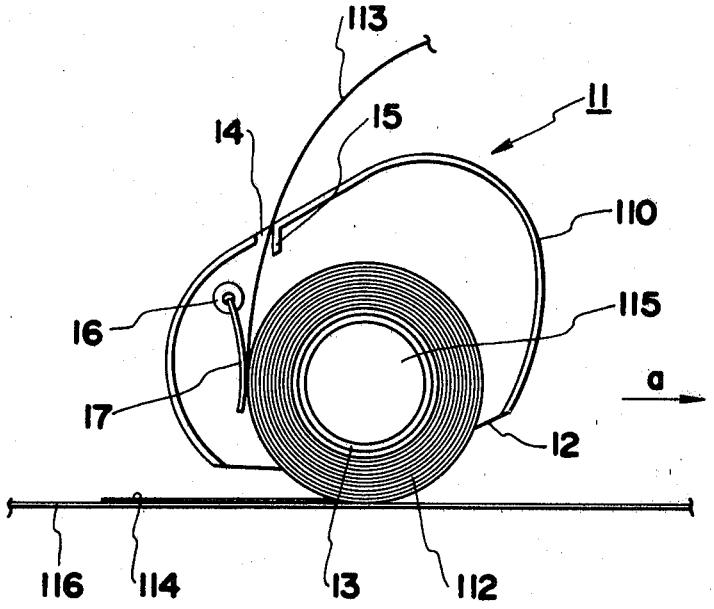
FIG. 3 is a front view of the device with a cover removed from the device.
Figure 4:
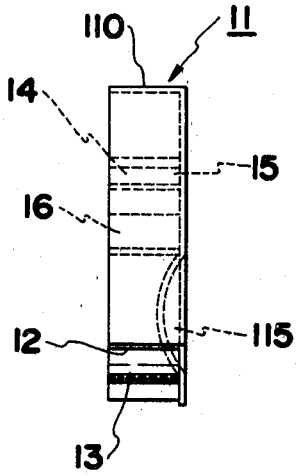
FIG. 4 is a side elevational view of the device with a cover and a tape roll removed from the device.
Figure 5:
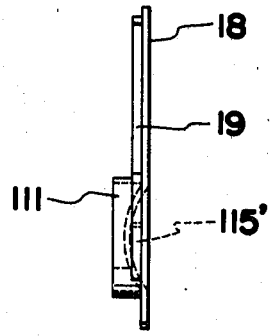
FIG. 5 is a side view of the cover used in the device of the invention.

Referring now to FIGS. 2 to 4, there is shown an adhesive tape transferring device 11 which comprises a casing 110 including a cover 18 removably mounted on the casing. As noted from FIGS. 2 and 3, the casing 110 is cut off at its lower edge and has an opening 12 provided therein. An outer roll support shaft 13 is provided on the casing body 110. The casing 110 and the roll support shaft 13 may be made of synthetic resin material. A spacer tape outlet 14 is provided at the top of the casing. A spacer tape feeding guide piece 15 may be provided integrally with the casing so as to be curved from the edge of the outlet 14 to prevent a spacer tape from reentering the casing 110. A resilient tape roll urging piece 17 is supported in the casing 10 by a supporting cylindrical member 16 which is in turn secured to the casing 110. As shown in FIGS. 2 and 3, the resilient urging piece 17 may be inserted into the supporting cylindrical member 16 through a groove provided therein. The resilient tape roll urging piece 17 may be of synthetic resin board having high resilient force. The resilient urging piece 17 is urged against an adhesive tape roll later described. As shown in FIG. 5, the cover 18 has an annular rib 19 provided thereon to be fitted onto the casing body 110.

An adhesive tape roll 112 includes a rolled adhesive film 114 having an pressure sensitive adhesive substance provided on one face thereof and a rolled spacer tape 113 disposed between the adjacent turns of the adhesive film 114. An inner roll support shaft 111 may be mounted on the cover 18. The inner roll support shaft has the outer diameter which allows it to be introduced into the outer roll support shaft 13.

As shown in FIGS. 4 and 5, holding recesses 115 and 115' may be provided in the casing body 110 and the cover 18 so that they face each other for engaging a thumb and a first or second finger of an user therewith. An operation of transferring the adhesive film 114 to an article 116 will be described later.

Figure 6:
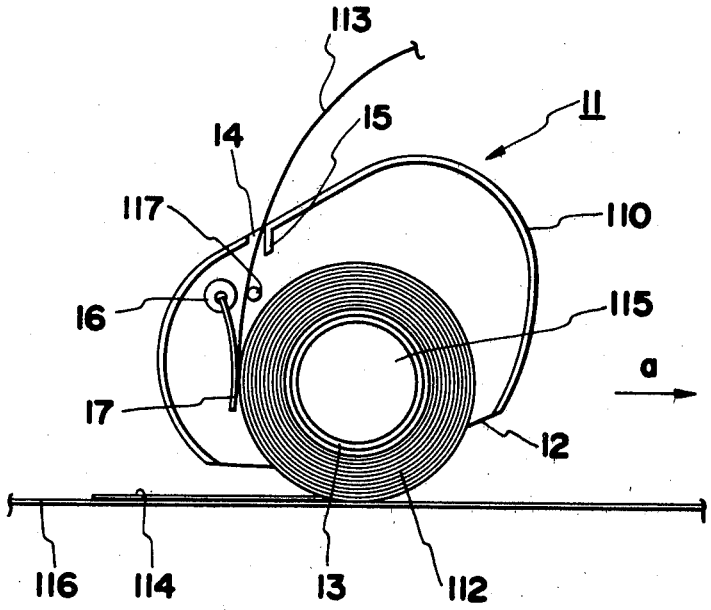
FIG. 6 is a front view of another embodiment of the device with the cover removed from the device.

FIG. 6 shows another embodiment of the device of the invention. The device of FIG. 6 is substantially identical to that of FIGS. 2 to 5 in its construction, except that an auxiliary guide 117 is mounted on the casing 110 near the supporting cylindrical member 16 for the resilient tape roll urging piece 17. The auxiliary guide 117 serves to linearly guide the spacer tape 113 toward the outlet 14 in the casing 110 without following the tape roll 112. Thus, it will be understood that although the spacer tape tends to be more curled as the diameter of the tape roll is reduced, the auxiliary guide 117 prevents the spacer tape from following the tape roll 112 so that it is smoothly fed out of the outlet 14.

In operation, after the cover 18 is removed out of the casing body 110, the tape roll 112 is rotatably supported on the outer tape roll shaft 13. Then, the spacer tape 113 is led through the tape roll urging piece 17 and through the outlet 14 out of the casing 110. Thereafter, an user holds the device 11 while his fingers engage the holding recesses 115 and 115', and rolls it in a direction as indicated at an arrow a of FIGS. 3 and 6 while forcing it against the article 116. Thus, the adhesive film 14 of the tape roll 112 is transferred to the article 116. At the same time, since the tape roll 112 is rotated, the spacer tape 113 after the adhesive film 114 is transferred is fed through the outlet 14 out of the casing 110. A length of the spacer tape 113 may be cut off. After a predetermined length of the adhesive film 114 is transferred to the article 116, the user forcely raises the whole device 11 so that it is cut off from the tape roll 112.

As the tape roll 112 is consumed, the diameter of the tape roll 112 is gradually reduced. The tape roll urging piece 17 is always urged against the tape roll 112 until all of it is consumed. Thus, even though the diameter of the tape roll 112 is reduced, the tape is prevented from its slackness by means of the tape roll urging piece 17. It will be noted that this ensures the adhesive film 116 is positively transferred to the articles.

Figure 1:
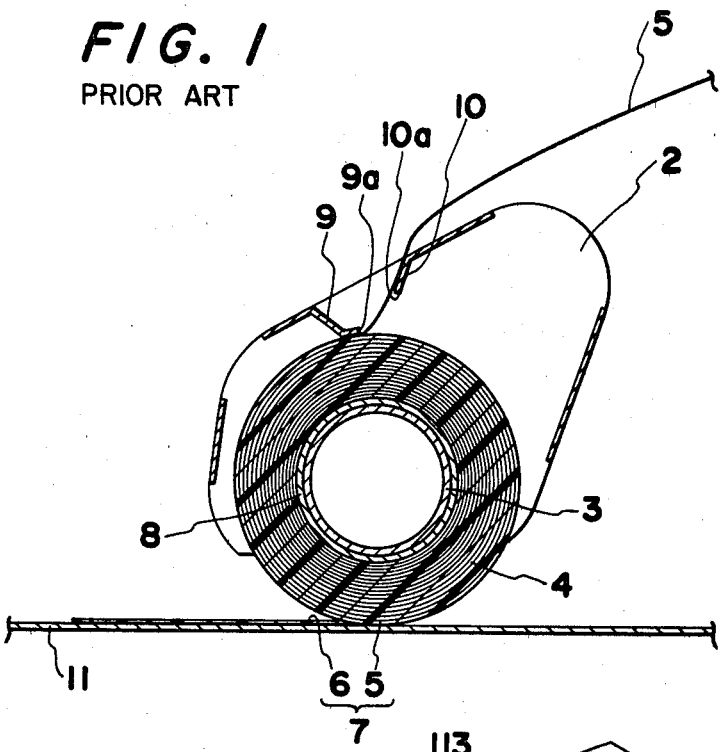
FIG. 1 PRIOR ART
FIG. 1 is a cross-sectional view of a prior device for automatically transferring to an article an adhesive film having an adhesive substance on one face thereof.

The spacer tape 113 removed from the tape roll 112 engages the tape roll urging piece 17 on one of the sides of the spacer tape and engages the guide piece 15 on another side of the spacer tape. This causes the spacer tape 113 to be smoothly fed out of the casing 110. The auxiliary guide 117 of FIG. 6 causes it to be more smoothly fed out of the casing 110. It will be understood that there is not required such a complicated construction as pieces 9 and 10 of FIG. 1 which face each other at a given angle and with a given urging force and which tend to vary in the angle and urging force of the pieces 9 and 10.

As described with respect to the conventional device, the adhesive film 116 is cut off by raising the whole device 11. At that time, the tape roll urging piece 17 prevents the tape roll 112 from being rotated in a reverse direction, which causes the adhesive film 116 to be positively cut off.

Figure 7:
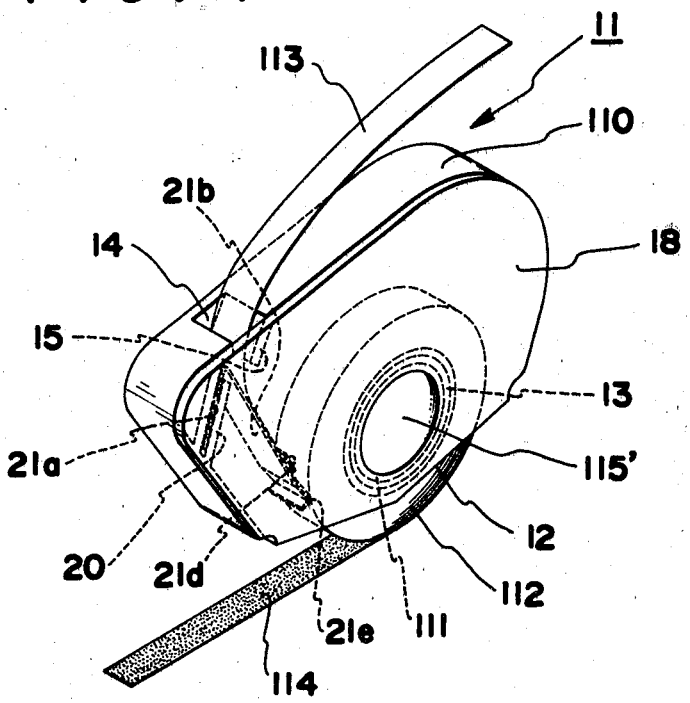
FIG. 7 is a perspective view of a further embodiment of the device.
Figure 8:
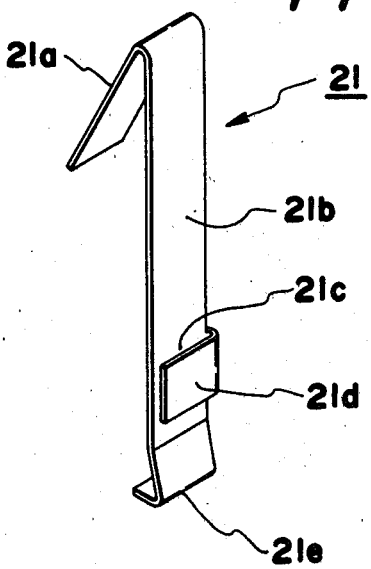
FIG. 8 is an enlarged perspective view of the spacer tape urging piece used in the device of FIG. 7.

FIG. 7 shows further embodiment of the invention. In the embodiment of FIG. 7, a spacer tape urging piece 21 which is formed as shown in FIG. 8 has a first bended portion **21*a* supported on a guide piece holder 20 which is provided in the form of fork on and within the casing 110. The urging piece 21 has a main body 21*b* formed integrally with the bended portion 21*a* and disposed toward the tape roll 112. A passage forming portion 21*d* is formed integrally with the main body 21*b* so that a passage 21*c* to forcefully pass the spacer tape 113 is formed between the main body 21*b* and the passage forming portion 21*d*. A second bended portion 21*e* is formed at a lower end of the main body 21*b* so that it is bent in the same direction. The second bended portion serves to normally pressurize the tape roll 112 as the spacer tape urging member. Thus, it will be understood that the spacer tape 113, after transferring, is moved through the upper face of the second bent portion 21*e* and the passage 21*c* and toward the outlet 14 of the device. So, it should be noted that the spacer tape is never flexed inwardly so that it is positively fed out of the outlet 14**.

While some preferred embodiments of the invention have been described and illustrated with reference to the accompanying drawings, it will be understood that they are by way of example and that various changes and modifications may be made without departing from the spirit and scope of the invention, which is intended to be defined only to the appended claims.

What is claimed is:

1. A device for automatically transferring an adhesive tape to an article comprising: a casing having an opening provided at its lower edge; a roll support shaft mounted on said casing; and a transferring adhesive tape roll rotatably supported on said roll support shaft, said tape roll including a rolled adhesive film having a pressure sensitive adhesive substance on one face thereof and a rolled, removable spacer tape disposed between the adjacent turns of said adhesive film and being so arranged that the lower adhesive face of said transferring adhesive tape roll protrudes from said opening in said casing and said casing having an outlet provided to feed said spacer tape out of said casing therethrough, said device further comprising a resilient spacer tape urging piece mounted on said casing to urge the removed spacer tape against said transferring adhesive tape roll in the course of being fed toward said outlet.

2. A device for automatically transferring an adhesive tape to an article as set forth in claim 1, and further comprising a guide piece provided at said outlet to feed said spacer tape out of said casing.

3. A device for automatically transferring an adhesive tape to an article as set forth in claim 1, further comprising a cylindrical member secured to said casing and wherein said resilient urging piece is inserted into said cylindrical member whereby said cylindrical member supports said resilient urging piece on said casing.

4. A device for automatically transferring an adhesive tape to an article as set forth in claim 3, and further comprising an auxiliary guide mounted on said casing between said supporting cylindrical member and said tape roll for guiding said spacer tape toward said outlet.

5. A device for automatically transferring an adhesive tape to an article as set forth in claim 1, wherein said resilient urging piece has a one end and and an other end and said one end is mounted on and within said casing, is formed with a passage to pass said spacer tape therethrough and has a spacer tape urging portion formed at said other end.

* * * * *